United States Patent [19]

Coffinberry et al.

[11] 4,096,910

[45] Jun. 27, 1978

[54] CONCENTRIC-TUBE STACKED PLATE HEAT EXCHANGER

[75] Inventors: George A. Coffinberry, Cincinnati; Howard B. Kast, Fairfield, both of Ohio

[73] Assignee: General Electric Company, Cincinnati, Ohio

[21] Appl. No.: 736,572

[22] Filed: Oct. 28, 1976

[51] Int. Cl.[2] ..... F28F 7/00; F28D 7/10

[52] U.S. Cl. ..... 165/81; 165/154; 165/164; 165/165; 165/179

[58] Field of Search ..... 165/109, DIG. 11, 141, 165/154, 165, 166, 167, 81; 211/41

[56] References Cited

U.S. PATENT DOCUMENTS

| | | | |
|---|---|---|---|
| 1,734,274 | 11/1929 | Schubart | 165/166 |
| 3,228,460 | 1/1966 | Garwin | 165/154 X |
| 3,433,299 | 3/1969 | Fleming | 165/154 X |
| 3,865,185 | 2/1975 | Ostbo | 165/165 |

*Primary Examiner*—Charles J. Myhre
*Assistant Examiner*—Theophil W. Streule, Jr.
*Attorney, Agent, or Firm*—Henry J. Policinski; Derek P. Lawrence

[57] ABSTRACT

A concentric-tube heat exchanger is provided which includes a first longitudinally extending annular flow passage adapted to provide a flow path for a first fluid flowing therein and a first plurality of annular heat transferring plates disposed consecutively in the axial direction in the annular flow passage. The plates extend radially across the annular passage and each have a first set of apertures extending axially through the plate. First means are provided for at least partially defining a second longitudinally extending flow passage for a second fluid. The second flow passage is disposed concentrically with the first annular flow passage and is in sufficient proximity thereto to permit a transfer of heat between the first and second fluids through said first plates in the radial direction.

13 Claims, 5 Drawing Figures

CONCENTRIC-TUBE STACKED PLATE HEAT EXCHANGER

BACKGROUND OF THE INVENTION

This invention relates to a heat exchanger arrangement for transferring thermal energy between one fluid and another and, more particularly, to a heat exchanger well adapted for use in exchanging thermal energy between the fuel and oil systems associated with an aircraft gas turbine engine.

In gas turbine engine technology, it is well known that engine fuel may be used to cool the engine oil used for lubrication. Typically, the thermal energy released from the engine oil during cooling is absorbed by the fuel about to be burned in the engine combustor. The cooled oil is hence better adapted to lubricate the rotating elements of the engine.

Prior art fuel-oil heat exchangers have included devices wherein a multiplicity of small-diameter thin-walled tubes, several hundred tubes in some designs, each carrying fuel internally, are arranged in parallel fashion with respect to the flow of fuel through the tubes. Each hollow tube is brazed or attached by mechanical means at its ends to inlet and outlet headers. Engine oil is directed over the external surfaces of the tubes between the headers whereby thermal energy is exchanged between the engine fuel and the engine oil. In such prior art devices, in the event of failure of the brazed joints between the tubes and the headers, leakage of high pressure engine fuel into the engine oil system may result. Accumulation of fuel in the oil system reduces the lubricating capacity of the oil as the result of a reduction in viscosity and may cause damage to bearing assemblies at various locations in the gas turbine engine serviced by the oil system.

Prior art heat exchangers, of the type described above, have employed intensive quality assurance procedures during manufacture in an attempt to preclude fuel contamination of the oil system. Consequently, performance of exhaustive inspection and testing procedures raises the manufacturing cost of the heat exchanger significantly.

High manufacturing costs may also be attributed to the large number of parts and assembly operations utilized in constructing the heat exchanger. Since prior art fuel exchangers of the type described above utilize bare tubes and little or no extended heat transfer surface, a large number of tubes is required to transfer the desired amount of thermal energy between the oil and the fuel. The attendant assembly, fixturing, joining and cleaning operations associated with fabrication of the heat exchanger comprised of so many individual pieces have also significantly increased the manufacturing cost of the heat exchanger.

Prior art heat exchangers also have been difficult to inspect. More specifically, since brazing, welding, tube expansion or other permanent assembly techniques have been utilized to assemble the multitude of components, it is not feasible to adequately inspect the condition of the tube joints after manufacture or to disassemble the heat exchanger in the field. Consequently, the condition of the heat exchanger at any point in time is not known and hence an unexpected failure of the heat exchanger may cause damage to the engine fuel or oil systems. The invention hereinafter described is addressed to overcoming the shortcomings and disadvantages associated with the design and manufacture of the aforedescribed prior art heat exchanger.

Another type of heat exchanger, utilizing tubes, known in the art is exhibited in U.S. Pat. No. 3,201,938 wherein a plurality of tubes are arranged in concentric fashion to form flow annuli between the tube surfaces. The annuli provide flow passages for the passage of fluid. As shown in the referenced patent, continuous axially extending fin structures reside in the annuli. Fluid flowing through the annuli travels parallel to the longitudinally extending heat transferring surface of the fin structure. This heat transfer mechanism has not proved to be entirely satisfactory. The present invention is directed at a concentric-tube heat exchanger having an improved heat transfer mechanism.

It is therefore an object of the present invention to provide a heat exchanger having improved heat transferring capability over conventional state-of-the-art heat exchangers.

It is another object of the present invention to provide a heat exchanger for transferring heat between two fluids wherein leakage of one fluid from its fluid circuit will not under any conditions result in contamination of the fluid in the other fluid circuit.

It is yet another object of the present invention to provide a heat exchanger having fewer component parts than prior art heat exchangers and which requires fewer assembly operations.

It is still another object of the present invention to provide a heat exchanger which is relatively simple in design, easy and inexpensive to manufacture.

SUMMARY OF THE INVENTION

Briefly stated, the above and other objects of the present invention, which will become apparent from the following specification and appended drawings are accomplished by the present invention which in one form provides an apparatus for transferring heat between first and second fluids. A first longitudinally extending annular flow passage adapted to provide a flow path for a first fluid flowing therein is disposed concentrically with a second longitudinally extending flow passage adapted to provide a flow path for a second fluid. First means are provided for at least partially defining the first and second flow passages. A first plurality of annular heat transferring plates are disposed consecutively in the first annular flow passage and extend radially across the first annular flow passage. The plates include a first set of apertures extending longitudinally therethrough and adapted to pass the first fluid. Second means are provided for establishing a radial heat conduction path between the first plurality of plates and the first means. The second means may include spacer means for maintaining an axial spacing between consecutively disposed plates of said first plurality. Resilient means may be provided for biasing the plates into engagement with the spacer means. The resilient means may cooperate with inclination means to bias the spacer means radially into heat transferring engagement with the first means.

DESCRIPTION OF THE DRAWINGS

While the specification concludes with claims distinctly claiming the invention described herein, it is believed that the invention will be more readily understood by reference to the accompanying drawings in which:

DESCRIPTION OF THE PREFERRED EMBODIMENT

Figures 1, 4:
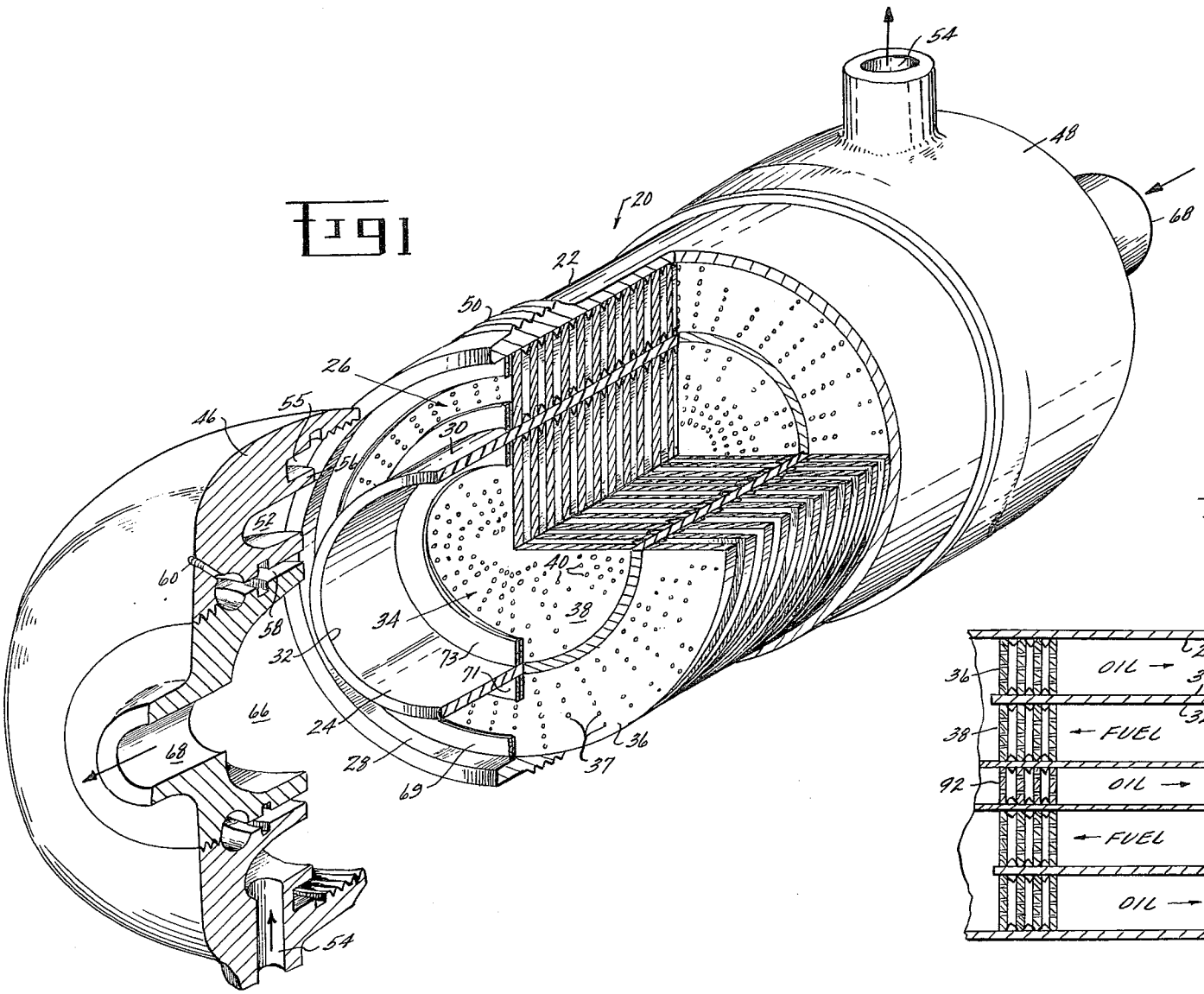
FIG. 1 is a partially exploded perspective view of the heat exchanger comprising the present invention.
FIG. 4 is a cross-sectional view of a core assembly comprising an alternative embodiment of the present invention.

Referring now to FIG. 1, the heat exchanger comprising the present invention, depicted generally at 20, is shown in a cutaway perspective view. Outer and inner axially or longitudinally extending cylindrical members 22, 24, respectively, are arranged coaxially about an X—X axis, so as to form a first axially extending annular flow passage 26 defined by and between the radially inwardly facing cylindrical surface 28 associated with cylindrical member 22 and the radially outwardly facing cylindrical surface 30 associated with cylindrical member 24. Radially inwardly facing cylindrical surface 32 on cylindrical member 24 defines a second axially extending flow passage 34 radially spaced inwardly from annular flow passage 26. It is observed that cylindrical member 24 provides means for partially defining flow passages 26 and 34. Flow passages 26 and 34 are adapted to permit the flow of first and second fluids, respectively, therethrough. By way of example, if heat exchanger 20 is used in a gas turbine engine system lubricating oil may flow through passage 26 and engine fuel may flow through passage 34.

A first plurality of substantially flat plate members 36 are disposed consecutively in the axial direction within the fluid passage 26. Each flat plate 36 extends radially from proximate the cylindrical surface 30 of cylindrical member 24 to proximate cylindrical surface 28 of cylindrical member 22. Flat plates 36 are relatively thin in the axial direction as compared to their radial extension and each include a first plurality of apertures 37 extending longitudinally through the plate in the axial direction and adapted to pass engine oil from one axial side of plate 36 to the other.

A second plurality of substantially flat plate members 38 are disposed consecutively in the axial direction within fluid passage 34. A second plurality of apertures 40 extend through each flat plate 38 in the axial direction and are adapted to pass the engine fuel from one axial side of the plate 38 to the other.

It should be noted that apertures 37 in consecutive spaced flat plates 36 are not in axial alignment. Hence, fluid emerging from apertures 37 in an upstream plate will impinge upon the surface between the apertures in the adjacent downstream plate 36. Impingement of the fluid on the plate provides a high rate of heat transfer between the fluid and the plates 36. The same axial non-alignment feature is utilized with respect to apertures 40 in consecutive flat plates 38.

A pair of spaced apart headers 46 and 48 are located at opposite axially spacial ends of cylindrical members 22, 24 provide fluid inlet and outlet means for flow passages 26 and 34. More specifically, header 46, disposed at the left end of the cylindrical members 22 and 24 (as viewed in FIGS. 1 and 2), is releaseably secured to outer cylindrical member 22 at threaded connection 50. Header 46 includes first annular chamber 52 in communication with fluid inlet port 54 and annular flow passage 26. Oil entering heat exchanger 20 through inlet port 54 is distributed by chamber 52 uniformly into the full circumferential expanse of annular flow passage 26 through which the oil flows in the leftward direction as viewed in FIG. 2. Header 46 further includes a first annular recess 55 disposed radially outwardly of chamber 52 and arranged to receive the left end of cylindrical member 22. Lip 56, disposed adjacent recess 55, projects inside cylindrical member 22 for purposes hereinafter to be described.

A second annular recess 58, disposed radially inwardly of annular chamber 52, receives the left end of cylindrical member 24. Vent 60 communicates recess 58 with atmosphere to permit fluid leaking past seals 62 and 64 to drain to atmosphere. Hence, fuel leaking into recess 58 will not find its way into the annular flow passage 26 associated with the lubricating oil.

Header 46 further includes a circular axially extending flow chamber 66 disposed radially inwardly of recess 58 and communicating annular flow passage 34 with fuel outlet port 68. Header 48 is constructed as substantially the mirror image of header 46 and cooperates with the right end (as viewed in FIG. 2) of cylindrical members 22 and 24 in a manner identical to that by which header 46 cooperates with the left end of cylindrical members 22 and 24. Port 68 in header 48 serves as a fuel inlet port to heat exchanger 20 while port 54 serves as the oil outlet.

Referring again to FIG. 2, spacer means are shown for maintaining flat plates 36 in an axially spaced relationship with respect to each other within fluid passage 26 and for maintaining flat plates 38 in an axially spaced relationship with respect to each other within fluid passage 34. More specifically, first and second pluralities of circumferentially extending annular wedge rings 68, 70, respectively, are disposed between adjacent flat plates 36. The first plurality of wedge rings 68 are located proximate the radially outer circumference of flat plates 36 while the second plurality of wedge rings 70 is disposed proximate the inner circumference of flat plate 36.

A third plurality of circumferentially extending annular wedge rings 72 is disposed within annular flow passage 34 for maintaining flat plates 38 axially spaced from each other within annular flow passage 34. Wedge rings 72 are disposed between flat plates 38 proximate the radially outer circumferential periphery thereof. As will hereinafter be more fully explained, in addition to maintaining proper plate spacing, wedge rings 68, 70 and 72 serve to operatively connect the flat plates 36 and 38 to cylindrical members 22 and 24 and hence provide a heat conduction path for the transfer of heat.

Disposed at one end of cylindrical members 22 and 24, a series of resilient members, 69, 71 and 73 are sandwiched between flat plates 36 and 38 and end cover 46. Resilient members 69, 71 and 73 may be comprised of circumferentially extending annular Belleville washers or springs such that when end cover 46 tightened at threaded connection 50, resilient members 69, 71 and 73 are caused to apply a compressive force to flat plates 36 and 38 for purposes hereinafter to be described.

Figures 2, 3, 5:
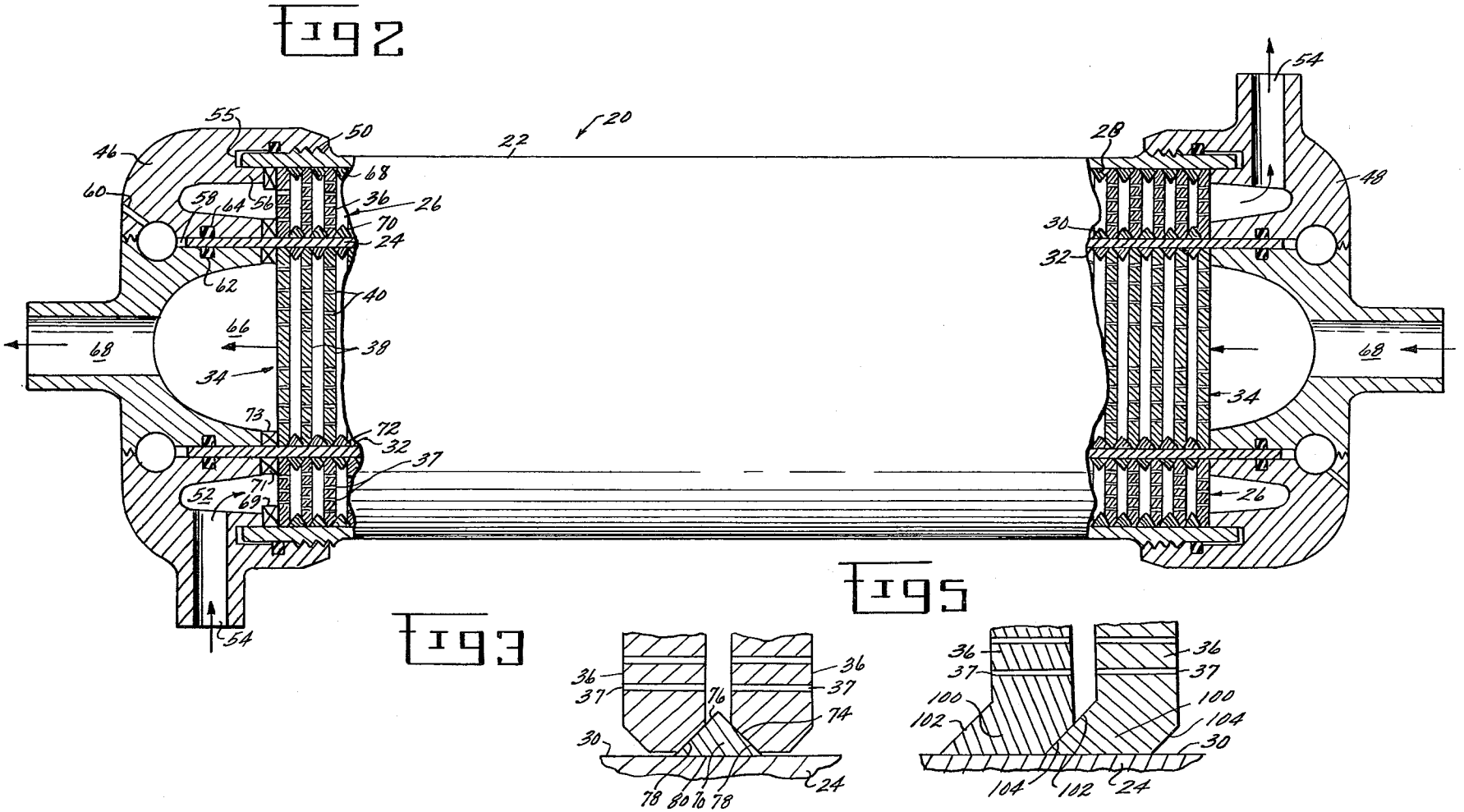
FIG. 2 is a partial cross-sectional side view of the heat exchanger depicted in FIG. 1.
FIG. 3 is an enlarged view depicting one feature of the present invention.
FIG. 5 is a cross-sectional enlarged view of an alternative feature of the present invention.

Referring to FIG. 3, an enlarged cross-sectional view, depicting the cooperation between the flat plate 36 and wedge rings 70 is exhibited. It should be understood that wedge rings 68 and 72 (which are not shown in FIG. 3) cooperate in an identical manner with their associated flat plates 36 and 38, respectively. Wedge rings 70 include circumferentially extending axially opposed circumferentially extending inclined faces 74, 76 which abuttingly engage complementary circumferentially extending inclined surfaces 78 on each flat plate 36. Radial face 80 on wedge ring 70 engages outer surface 30 on cylindrical member 24. Due to the compressive force exerted on the plurality of flat plates 36 by springs 69 and 71, inclined faces 74 and 76 on wedge rings 70 tightly engage the inclined surfaces 78 on each of the adjacent flat plates 36 to ensure adequate surface contact for the transfer of heat between the plurality of flat plates 36 and the wedge rings 70. As a consequence of the inclination of the interface between wedge rings 70 and flat plates 36, the compressive force applied by resilient means 69 and 71 causes a force component in the radially inward direction to be applied to wedge ring 70. The radial force ensures adequate surface contact between radial face 80 of wedge ring 70 and outer surface 30 of cylindrical member 24 to enhance heat transfer between the plurality wedge rings 70 and cylindrical member 24.

The utilization of wedge rings 70 in cooperation with resilient members 69, 71 and 73 eliminates the necessity for brazing operations commonly found in state-of-the-art heat exchangers. Since application of the compressive force insures both axial and radial surface contact between the elements in the heat transfer path, brazing is not necessary. Consequently, disassembly of the heat exchanger is facilitated for inspection and servicing.

Operation of the heat exchanger 20 will now be described. Fuel enters fuel inlet 68 port in end cover 48 and sequentially flows through the plurality of flat plates 38 in flow passage 34 and out of the heat exchanger 20 through outlet port 68 in end cover 46. During its transit through passage 34, the fuel transfers heat to flat plates 38 which, in turn, convey heat to wedge rings 72. The cylindrical member 24 receives heat from wedge ring 72 and, in turn, passes heat to wedge ring 70. Flat plates 36 disposed in annular flow passage 26 receive the heat from wedge rings 69. Oil entering oil inlet port 54 in end cover 46 is distributed by annular chamber 52 about the circumferential expanse of annular flow passage 26. Oil flowing through apertures 37 in flat plates 36 impinges upon the adjacent downstream plate 36 and in so doing exchanges heat with flat plates 36. The oil exits heat exchanger 20 through oil exit port 54 and end cover or header 48.

An alternative embodiment of the heat exchanger core is partially depicted in cross section in FIG. 4. The FIG. 4 embodiment differs from the FIG. 2 embodiment in that in the former a third cylindrical member 90 is disposed within cylindrical member 24 such that flow passage 34 is annular in cross section. Cylindrical member 90 includes flat plates 92 therewithin disposed in the same manner described for the previous embodiments. In this alternative embodiment flat plates 38, which are annular, conduct heat both radially inwardly and radially outwardly, thereby reducing the thermal resistance path length of flat plates 38. Fuel flows through passage 34 while oil flows through passage 26 and the center of the tube 90, both oil passages flowing in the same direction. The application of wedge rings, resilient means and headers to the core shown in FIG. 3 may be readily accomplished in a manner similar to and consistent with that taught with reference to the FIG. 2 embodiment. Hence, it is not deemed necessary to further describe in detail the similar features contained in the embodiment shown in FIG. 4.

Referring now to FIG. 5, an alternative spacer means is disclosed as integral portions of flat plates 36. More specifically, each flat plate 36 includes an axial projection 100 extending from the periphery of the flat plate 36. Axial projections 100 each include axially spaced circumferentially extending annular inclined forward and aft facing surfaces 102, 104 respectively. The forward facing inclined surface 102 on each flat plate 36 is adapted to engage the aft facing inclined surface 104 on the next adjacent flat plate 36. Upon application of an axial force, as by the Belleville springs 69, 71 or 73 used in the FIG. 2 embodiment, projections 100 are deformed radially into abutting engagement with surface 30 of cylindrical member 24. Projections 100 serve to provide a heat conduction path for the transfer of heat between flat plates 36 and cylindrical member 24. In this manner, then, projections 100 provide the same function as the wedge ring associated with the embodiment previously described herein.

While the preferred and alternative embodiments of the invention have been described to enable an understanding of the invention, it is understood that the present invention is not to be regarded as limited to the exact detail of the description given herein but that modifications may be made to those embodiments which do not depart from the substance of the invention set forth in the appended claims.

We claim:

1. In an apparatus for transferring heat between first and second fluids, the improvement comprising:

a first longitudinally extending annular flow passage adapted to provide a flow path for a first fluid flowing therein;

a second longitudinally extending flow passage adapted to provide a flow path for a second fluid flowing therein, said second flow passage disposed concentrically with said first annular flow passage first tubular means for at least partially defining said first and second flow passages a first plurality of annular heat transferring plates disposed consecutively in the longitudinal direction in said first annular flow passage and extending radially across said first annular flow passage said plates including a first set of apertures extending longitudinally therethrough and adapted to pass said first fluid spacer means for maintaining an axial spacing between consecutively disposed plates of said first plurality of plates and for providing a radial heat conduction path and resilient means for biasing said spacer means in the radial direction and into heat transferring engagement with said first tubular means.

2. The invention as set forth in claim 1 wherein said second flow passage is disposed radially inwardly of said first annular flow passage.

3. The invention as set forth in claim 1 further including resilient means for resiliently biasing said plates into engagement with said spacer means.

4. The invention as set forth in claim 3 wherein said resilient means cooperates with inclination means to bias said spacer means in the radial direction and into heat transferring engagement with said first means.

5. The invention as set forth in claim 1 wherein at least a pair of plates comprising said plurality include radially inward circumferential portions and radially outward circumferential portions and said spacer means further comprise a first series of annular rings disposed between said pair of plates and in locating engagement with said radially outward portions and a second series of annular rings disposed between said plates and in locating engagement with said radially inward portions.

6. The invention as set forth in claim 1 wherein said first tubular means comprises a first longitudinally extending generally cylindrical member partially defining said first annular flow passage and said second annular flow passage.

7. The invention as set forth in claim 6 further comprising a second plurality of heat transferring plates disposed consecutively in the axial direction in said second flow passage and extending radially across said second flow passage, each plate of said second plurality having a second set of apertures extending axially therethrough and adapted to pass said second fluid.

8. The invention as set forth in claim 7 wherein said first plurality of plates are disposed radially outward of said first cylindrical member and said second plurality of plates are disposed radially inward of said first cylindrical member.

9. The invention as set forth in claim 8 wherein said spacer means provides a heat conduction path between said first plurality of plates and said first cylindrical member and between said second plurality of plates and said first cylindrical member.

10. The invention as set forth in claim 9 wherein said spacer means comprises spacer members for maintaining an axial spacing between consecutively disposed flat plates in said first and second pluralities, said spacer members at least partially comprising said conduction path.

11. The invention as set forth in claim 10 wherein said resilient means cooperate with inclination means for biasing said spacer members into engagement with said first cylindrical member.

12. The invention as set forth in claim 9 wherein said second flow path is of annular configuration.

13. The invention as set forth in claim 12 wherein said first tubular means is further comprised of a second longitudinally extending generally cylindrical member disposed within said first cylindrical member and partially defining said second annular flow passage.

* * * * *